US010918915B1

(12) United States Patent
Moylan

(10) Patent No.: US 10,918,915 B1
(45) Date of Patent: Feb. 16, 2021

(54) METHOD FOR PRINTING AN IMAGE AT MULTIPLE LOCATIONS ON A GOLF BALL

(71) Applicant: Callaway Golf Company, Carlsbad, CA (US)

(72) Inventor: Maeve Moylan, Wilbraham, MA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/866,452

(22) Filed: May 4, 2020

Related U.S. Application Data

(60) Provisional application No. 62/844,012, filed on May 6, 2019, provisional application No. 62/845,630, filed on May 9, 2019, provisional application No. 62/846,036, filed on May 10, 2019.

(51) Int. Cl.

| | |
|---|---|
| ***B41M 1/40*** | (2006.01) |
| ***B41F 17/30*** | (2006.01) |
| ***A63B 45/02*** | (2006.01) |
| *A63B 37/00* | (2006.01) |

(52) U.S. Cl.
CPC ..... *A63B 45/02* (2013.01); *B41M 1/40* (2013.01); *A63B 37/0022* (2013.01)

(58) Field of Classification Search
CPC ..... B41M 1/40; B41F 17/30; B41F 17/001; A63B 45/02; A63B 37/0022
USPC ..... 101/37, 40.1, DIG. 40
See application file for complete search history.

(56) References Cited

U.S. PATENT DOCUMENTS

2009/0031904 A1* 2/2009 Vieira ..... B41F 17/001 101/35
2011/0100241 A1* 5/2011 Vogt ..... B41F 17/001 101/333
2011/0292146 A1* 12/2011 Sigismondo ..... B41J 11/002 347/104

* cited by examiner

*Primary Examiner* — Leslie J Evanisko
(74) *Attorney, Agent, or Firm* — Michael A. Catania; Sonia Lari; Rebecca Hanovice

(57) ABSTRACT

A method and system for printing an image at multiple locations on a golf ball is disclosed herein. The printing station comprises a plurality of stamping stations, each of the plurality of stamping stations comprising a pad carousel comprising a plurality of pads, a plurality of curing stations, and a plurality of reorienting stations.

4 Claims, 25 Drawing Sheets

| Tour Truvis | |
|---|---|
| ACTION | ARTWORK |
| Load | |
| Index | |
| Stamp | - |
| Rotate fixture 135 deg | |
| Stamp | Red line (1 of 2) |
| No rotate | |
| Stamp | Blue lines (1 of 2) |
| Rotate fixture 90 deg | |
| Stamp | Red line (2 of 2) |
| No rotate | |
| Stamp | Blue lines (2 of 2) |
| Rotate fixture 135 deg | |
| Index | |
| Cure (x4 90 eg rotations) | |
| Index | |
| Reorient 90 deg | |
| Index | |
| Index | |
| Stamp | - |
| Rotate fixture 90 deg | |
| Stamp | Pole A1 (ex. #) |
| No rotate | |
| Stamp | Pole A2 (ex. Callaway, sidestamp) |
| Rotate fixture 180 deg | |
| Stamp | Pole B1 (ex. #) |
| No rotate | |
| Stamp | Pole B2 (ex. Callaway, sidestamp) |
| Index | |
| Cure (x4 90 eg rotations) | |
| Index | |
| Unload | |

| Tour Truvis | |
|---|---|
| ACTION | ARTWORK |
| Load | |
| Index | |
| Stamp | 2 pent |
| Rotate fixture 45 deg | |
| Stamp | Sidestamp |
| Rotate fixture 45 deg | |
| Stamp | 2 pent |
| Rotate fixture 90 deg | |
| Stamp | 2 pent |
| Rotate fixture 90 deg | |
| Stamp | 2 pent |
| Index | |
| Cure (x4 90 eg rotations) | |
| Index | |
| Reorient 90 deg | |
| Index | |
| Index | |
| Stamp | - |
| Rotate fixture 90 deg | |
| Stamp | Pole stamp A1 (ex. Callaway, sidestamp) |
| Stamp | Pole stamp A2 (ex. #) |
| Rotate fixture 180 deg | |
| Stamp | Pole stamp B1 (ex. Callaway, sidestamp) |
| Stamp | Pole stamp B2 (ex. #) |
| Index | |
| Cure (x4 90 eg rotations) | |
| Index | |
| Unload | |

FIG. 7

Current Recipe: Tour Truvis

| | | | |
|---|---|---|---|
| STA01 Load 1 Enabled | 1 | STA05 Load 2 Enabled | 0 |
| STA02 Printer 1 Enabled | 1 | STA06 Printer 2 Enabled | 1 |
| STA02 Ball Rotate Degree 1st | 0 | STA06 Ball Rotate Degree 1st | 0 |
| STA02 Ball Rotate Degree 2nd | 45 | STA06 Ball Rotate Degree 2nd | 90 |
| STA02 Ball Rotate Degree 3rd | 45 | STA06 Ball Rotate Degree 3rd | 0 |
| STA02 Ball Rotate Degree 4th | 90 | STA06 Ball Rotate Degree 4th | 180 |
| STA02 Ball Rotate Degree 5th | 90 | STA06 Ball Rotate Degree 5th | 0 |
| STA02 Ball Rotate Degree 6th | 0 | STA06 Ball Rotate Degree 6th | 0 |
| STA03 UV Cure 1 Enabled | 1 | STA07 UV Cure 2 Enabled | 1 |
| STA03 UV Cure Degree | 90 | STA07 UV Cure Degree | 90 |
| STA04 Unload 1 Enabled | 0 | STA08 Unload 2 Enabled | 1 |
| STA04 Reorient 1 Enabled | 1 | | |
| STA04 Reorient Move Position | 90 | | |

RETURN

FIG. 8

| Tour Truvis | |
|---|---|
| ACTION | ARTWORK |
| Load | |
| Index | |
| Stamp | 1 pent |
| Rotate fixture 90 deg | |
| Stamp | 2 pent |
| Rotate fixture 90 deg | |
| Stamp | 1 pent |
| Rotate fixture 90 deg | |
| Stamp | 2 pen w notch |
| No rotate | |
| Stamp | Sidestamp |
| Index | |
| Cure (x4 90 eg rotations) | |
| Index | |
| Reorient 90 deg | |
| Index | |
| Index | |
| Stamp | - |
| Rotate fixture 90 deg | |
| Stamp | Pole A (ex. Callaway, #) |
| Rotate fixture 90 deg | |
| Stamp | - |
| Rotate fixture 90 deg | |
| Stamp | Pole B (ex. Callaway, #) |
| No rotate | |
| Stamp | - |
| Index | |
| Cure (x4 90 eg rotations) | |
| Index | |
| Unload | |

FIG. 11

Current Recipe: Truvis Complete

| | | | |
|---|---|---|---|
| STA01 Load 1 Enabled | 1 | STA05 Load 2 Enabled | 0 |
| STA02 Printer 1 Enabled | 1 | STA06 Printer 2 Enabled | 1 |
| STA02 Ball Rotate Degree 1st | 0 | STA06 Ball Rotate Degree 1st | 0 |
| STA02 Ball Rotate Degree 2nd | 90 | STA06 Ball Rotate Degree 2nd | 90 |
| STA02 Ball Rotate Degree 3rd | 90 | STA06 Ball Rotate Degree 3rd | 90 |
| STA02 Ball Rotate Degree 4th | 90 | STA06 Ball Rotate Degree 4th | 90 |
| STA02 Ball Rotate Degree 5th | 0 | STA06 Ball Rotate Degree 5th | 0 |
| STA02 Ball Rotate Degree 6th | 0 | STA06 Ball Rotate Degree 6th | 0 |
| STA03 UV Cure 1 Enabled | 1 | STA07 UV Cure 2 Enabled | 1 |
| STA03 UV Cure Degree | 90 | STA07 UV Cure Degree | 90 |
| STA04 Unload 1 Enabled | 0 | STA08 Unload 2 Enabled | 1 |
| STA04 Reorient 1 Enabled | 1 | | |
| STA04 Reorient Move Position | 90 | | |

RETURN

FIG. 12

| Tour Truvis | |
|---|---|
| ACTION | ARTWORK |
| Load | |
| Index | |
| Stamp | - |
| Rotate fixture 135 deg | |
| Stamp | Red line (1 of 2) |
| No rotate | |
| Stamp | Blue lines (1 of 2) |
| Rotate fixture 90 deg | |
| Stamp | Red line (2 of 2) |
| No rotate | |
| Stamp | Blue lines (2 of 2) |
| Rotate fixture 135 deg | |
| Index | |
| Cure (x4 90 eg rotations) | |
| Index | |
| Reorient 90 deg | |
| Index | |
| Index | |
| Stamp | - |
| Rotate fixture 90 deg | |
| Stamp | Pole A1 (ex. #) |
| No rotate | |
| Stamp | Pole A2 (ex. Callaway, sidestamp) |
| Rotate fixture 180 deg | |
| Stamp | Pole B1 (ex. #) |
| No rotate | |
| Stamp | Pole B2 (ex. Callaway, sidestamp) |
| Index | |
| Cure (x4 90 eg rotations) | |
| Index | |
| Unload | |

FIG. 14

Current Recipe: Triple Track

| | | | |
|---|---|---|---|
| STA01 Load 1 Enabled | 1 | STA05 Load 2 Enabled | 0 |
| STA02 Printer 1 Enabled | 1 | STA06 Printer 2 Enabled | 1 |
| STA02 Ball Rotate Degree 1st | 0 | STA06 Ball Rotate Degree 1st | 0 |
| STA02 Ball Rotate Degree 2nd | 135 | STA06 Ball Rotate Degree 2nd | 90 |
| STA02 Ball Rotate Degree 3rd | 0 | STA06 Ball Rotate Degree 3rd | 0 |
| STA02 Ball Rotate Degree 4th | 90 | STA06 Ball Rotate Degree 4th | 180 |
| STA02 Ball Rotate Degree 5th | 0 | STA06 Ball Rotate Degree 5th | 0 |
| STA02 Ball Rotate Degree 6th | 135 | STA06 Ball Rotate Degree 6th | 0 |
| STA03 UV Cure 1 Enabled | 1 | STA07 UV Cure 2 Enabled | 1 |
| STA03 UV Cure Degree | 90 | STA07 UV Cure Degree | 90 |
| STA04 Unload 1 Enabled | 0 | STA08 Unload 2 Enabled | 1 |
| STA04 Reorient 1 Enabled | 1 | | |
| STA04 Reorient Move Position | 90 | | |

RETURN

FIG. 15

METHOD FOR PRINTING AN IMAGE AT MULTIPLE LOCATIONS ON A GOLF BALL

CROSS REFERENCES TO RELATED APPLICATIONS

The Present Application claims priority to U.S. Provisional Patent Application No. 62/844,012, filed on May 6, 2019, U.S. Provisional Patent Application No. 62/845,630, filed on May 9, 2019, and U.S. Provisional Patent Application No. 62/846,036, filed on May 10, 2019, each of which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to a method for printing an image at multiple locations on an unfinished golf ball.

Description of the Related Art

The prior art discloses various methods for printing images on a surface of a golf ball.

However, the prior art has failed to disclose a method for printing an multiple colors on a golf ball in a single cycle.

BRIEF SUMMARY OF THE INVENTION

The present invention provides a method for printing an image at multiple locations on a golf ball in a cost effective and efficient manner.

One aspect of the present invention is a system for printing multiple colors on a golf ball. The system comprises a source of golf balls and a printing station. The printing station comprises a plurality of stamping stations, each of the plurality of stamping stations comprising a pad carousel comprising a plurality of pads, a plurality of curing stations, and a plurality of reorienting stations. Golf balls from the source of golf balls are loaded onto the printing station for applying multiple colors onto each golf ball.

Another aspect of the present invention is a method for printing images on a golf ball. The method includes loading a golf ball onto a printing machine. The method also includes placing the golf ball into a fixture. The method also includes transferring the golf ball to a first stamping station, wherein the first stamping station has a pad carousel with five stamping pads for stamping the golf ball. The method also includes stamping the golf ball at the first stamping station to create a first stamped golf ball. The method also includes transferring the first stamped golf ball to a first curing station. The method also includes curing at the first stamped golf ball at the first curing station to create a first cured golf ball. The method also includes transferring the first cured golf ball to a first reorienting station. The method also includes reorienting the first cured golf ball at the reorienting station into a second orientation. The method also includes transferring the first cured golf ball in a second orientation to a second stamping station, wherein the second stamping station has a pad carousel with five stamping pads for stamping the first cured golf ball in a second orientation. The method also includes stamping the first cured golf ball in a second orientation at the second stamping station to create a second stamped golf ball. The method also includes transferring the second stamped golf ball to a second curing station. The method also includes curing at the second stamped golf ball at the second curing station to create a second cured golf ball. The method also includes transferring the second cured golf ball to a second reorienting station. The method also includes reorienting the second cured golf ball at the reorienting station into a third orientation. The method also includes transferring the second cured golf ball in the third orientation to a third stamping station, wherein the third stamping station has a pad carousel with five stamping pads for stamping the second cured golf ball in the third orientation. The method also includes stamping the second cured golf ball in the third orientation at the third stamping station to create a third stamped golf ball. The method also includes transferring the third stamped golf ball to a third curing station. The method also includes curing at the third stamped golf ball at the third curing station to create a third cured golf ball. The method also includes transferring the third cured golf ball to a third reorienting station. The method also includes reorienting the third cured golf ball at the reorienting station into a fourth orientation. The method also includes transferring the third cured golf ball in the fourth orientation to a fourth stamping station, wherein the fourth stamping station has a pad carousel with five stamping pads for stamping the third cured golf ball in the fourth orientation. The method also includes stamping the third cured golf ball in the fourth orientation at the fourth stamping station to create a fourth stamped golf ball. The method also includes transferring the fourth stamped golf ball to a fourth curing station. The method also includes curing at the fourth stamped golf ball at the fourth curing station to create a fourth cured golf ball. The method also includes unloading the fourth cured golf ball from the printing station.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 7 is a table for instructions for a printing machine for printing multiple colors on a golf ball.

FIG. 8 is a screen shot of a process status of a machine for printing multiple colors on a golf ball.

FIG. 11 is a table for instructions for a printing machine for printing multiple colors on a golf ball.

FIG. 12 is a screen shot of a process status of a machine for printing multiple colors on a golf ball.

FIG. 14 is a table for instructions for a printing machine for printing multiple lines on a golf ball.

FIG. 15 is a screen shot of a process status of a machine for printing multiple lines on a golf ball.

DETAILED DESCRIPTION OF THE INVENTION

As shown in FIGS. 7-10, the machine stamp four sets of two pentagons and sidestamp, cures, reorients, and prints two single color logos. To make this ball work on a printing machines, a code for a new rotation/reorientation pattern is needed. This ball is not possible without the 45 degree cams. If the 90 degree cams were used, the sidestamp would not be on the same machine as the pentagons therefor it would not hold its alignment within the pentagons. Uses 45 degree fixture/cam rotations to get proper alignment and stamping on P1.

Figure 13:
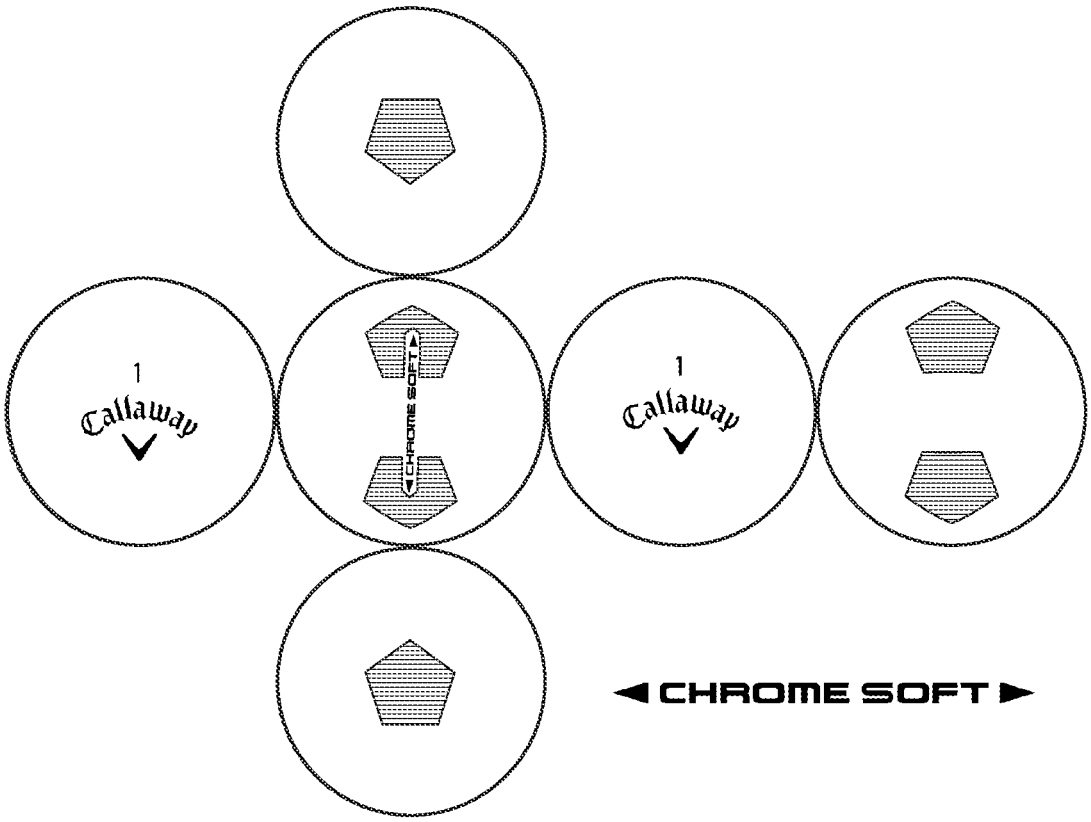
FIG. 13 is golf ball graphics.
Figure 16:
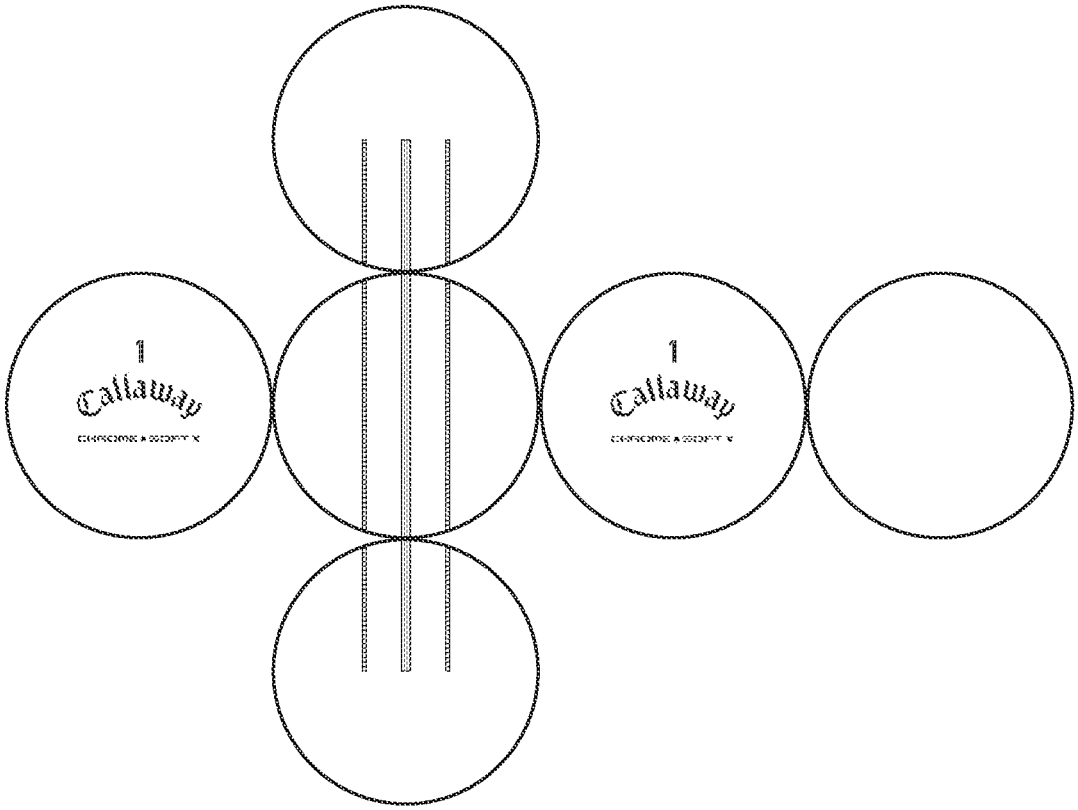
FIG. 16 is golf ball graphics.
Figure 17:
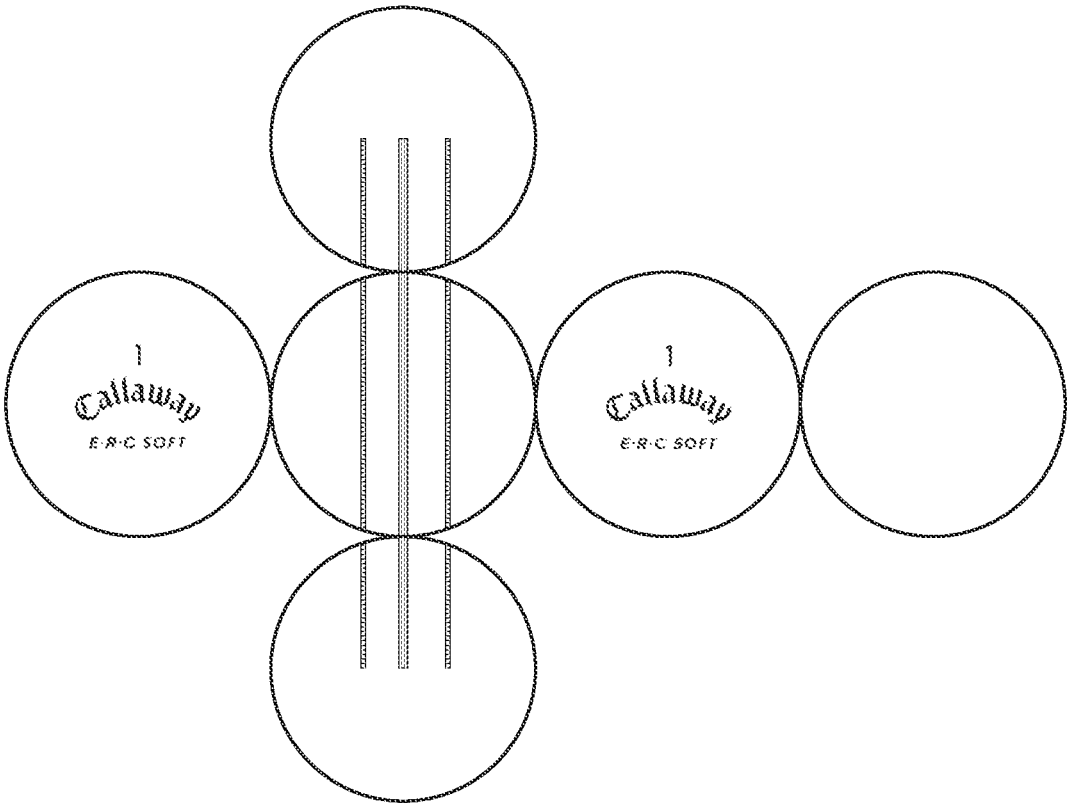
FIG. 17 is an image of golf balls.

As shown in FIGS. 11-13, a player will align the ball with the sidestamp and while it is rolling, the pentagons will roll over each other. To make this ball work on a multi-color printing machines, it needed code for new rotation/reorientation pattern. This ball is not possible without the 45 degree cams. If the 90 degree cams were used, the sidestamp would not be on the same machine as the pentagons therefor it would not hold its alignment within the pentagons.

As shown in FIGS. 14-17, Stamping 3 (2 color) $0<x<180$ degree lines around a golf ball in two separate halves. Any combination of 2 colors in the three lines. Stamping 2 pole stamps. Each pole stamp would be 1-2 colors. The lines are connected by a small overlap portion of the 2 line halves. To make this ball work on a multi-color printing machines, a code for new rotation/reorientation pattern is needed. This ball is not possible without the 45 degree cams. If the 90 degree cams were used, the sidestamp would not be on the same machine as the pentagons therefor it would not hold its alignment within the pentagons. Uses 45 degree fixture/cam rotations to get proper alignment and stamping on P1.

Figure 1:
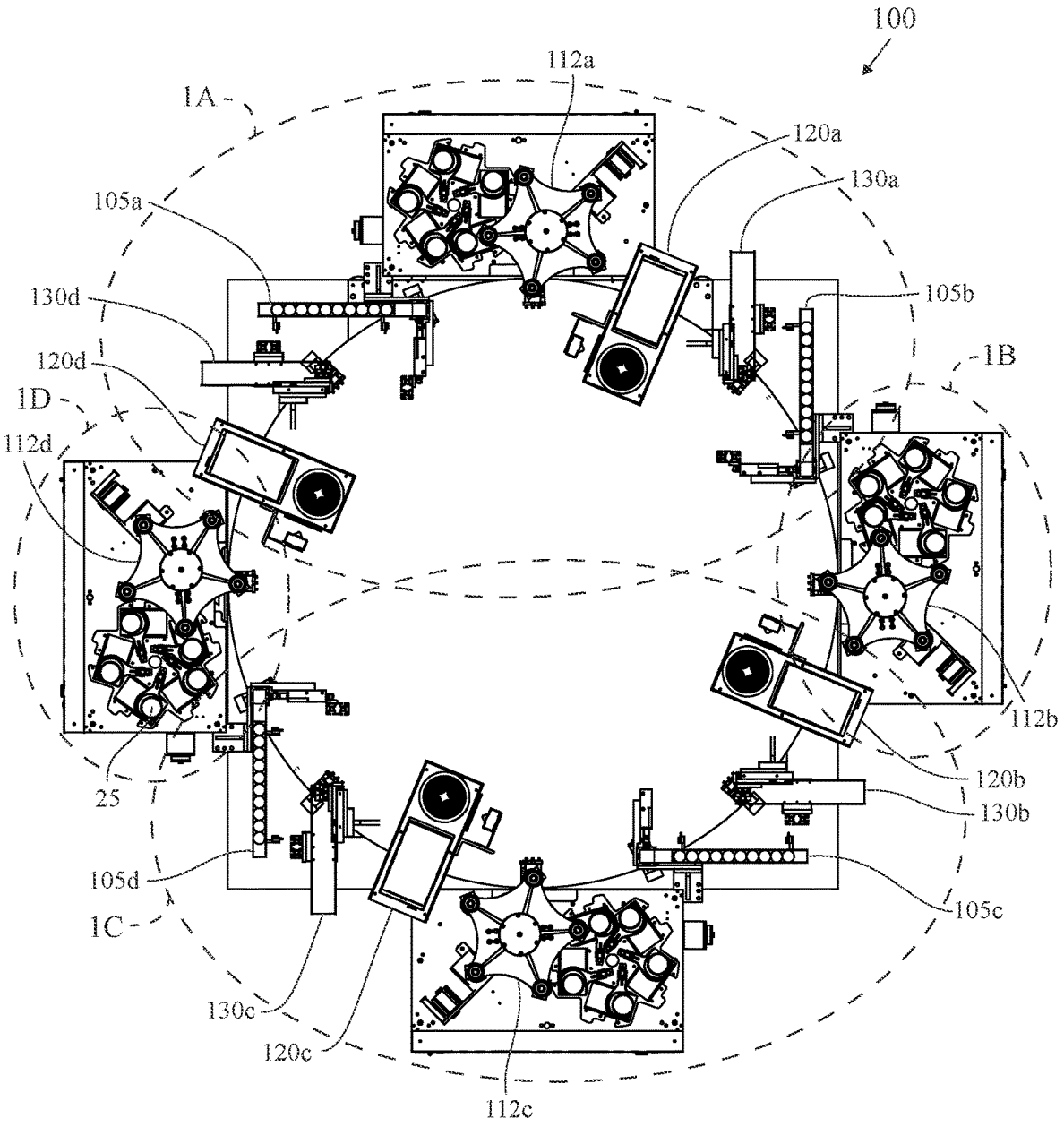
FIG. 1 is a top plan view of a preferred embodiment of a system for printing multiple colors on a golf ball.
Figure 1A:
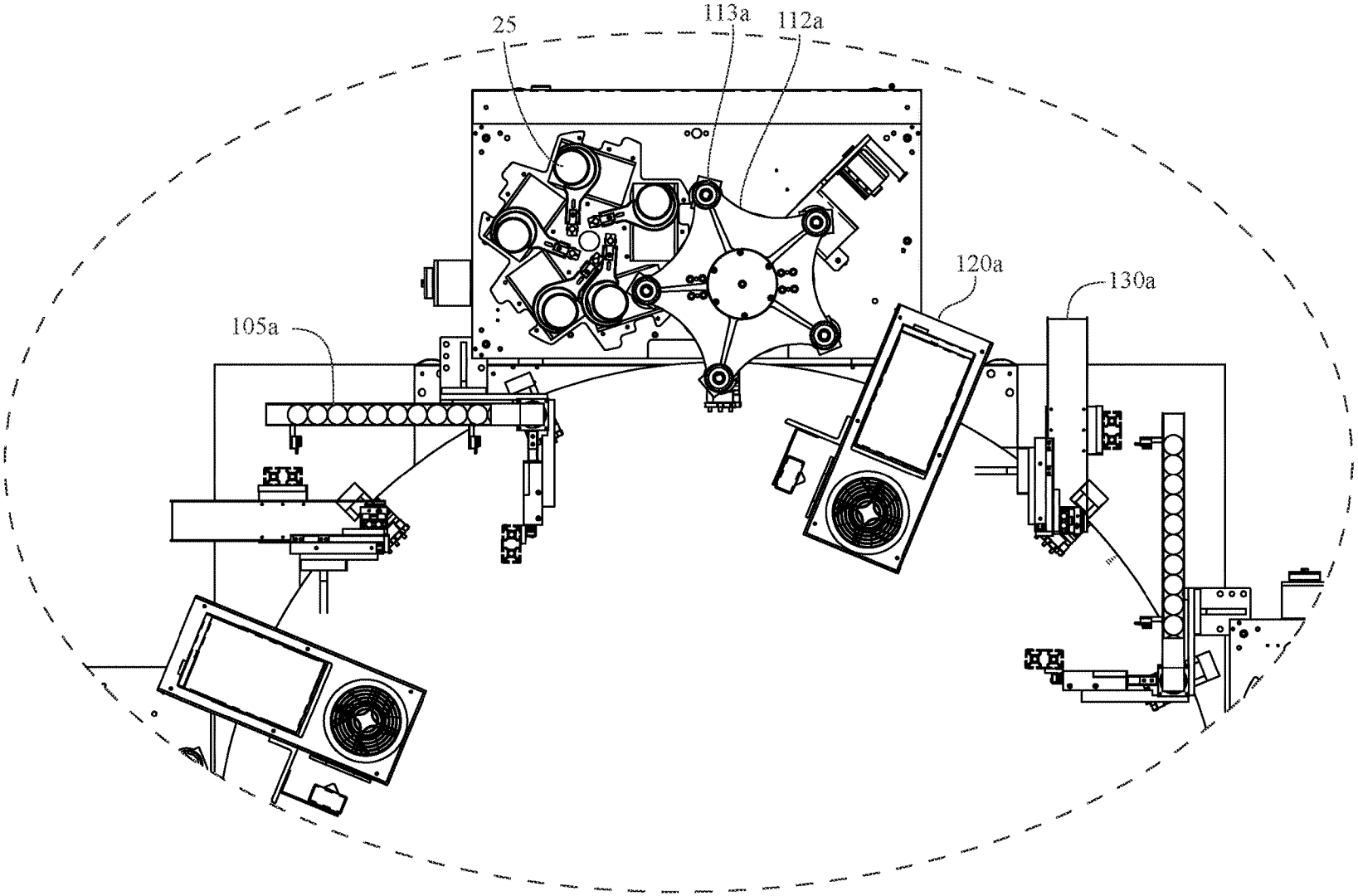
FIG. 1A is an isolated view of circle 1A of FIG. 1.
Figure 1B:
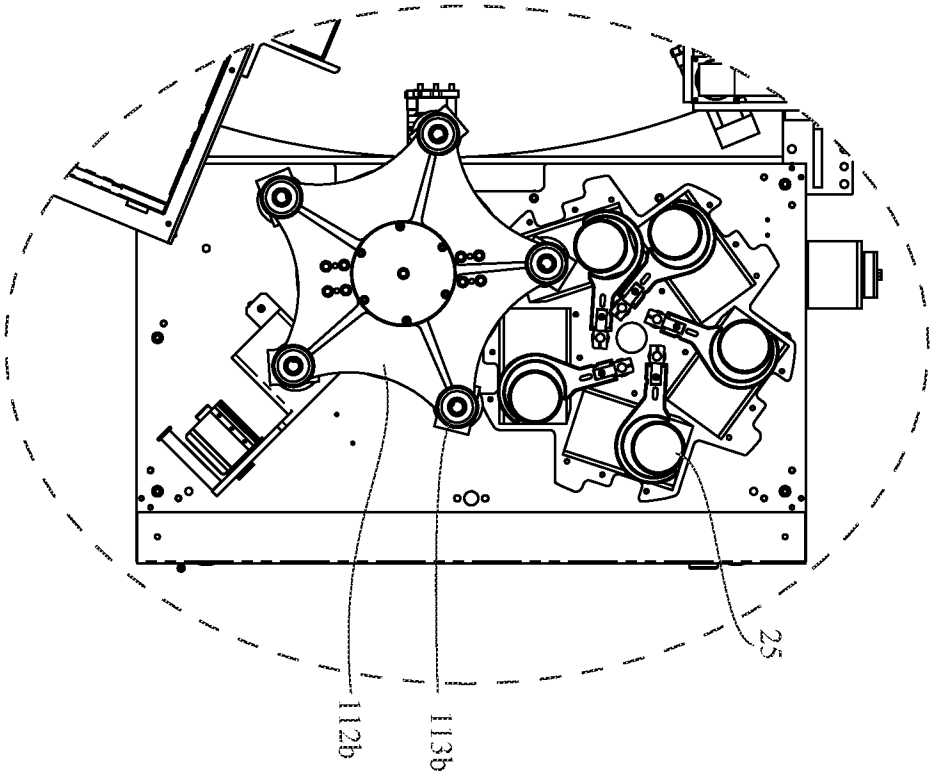
FIG. 1B is an isolated view of circle 1B of FIG. 1.
Figure 1C:
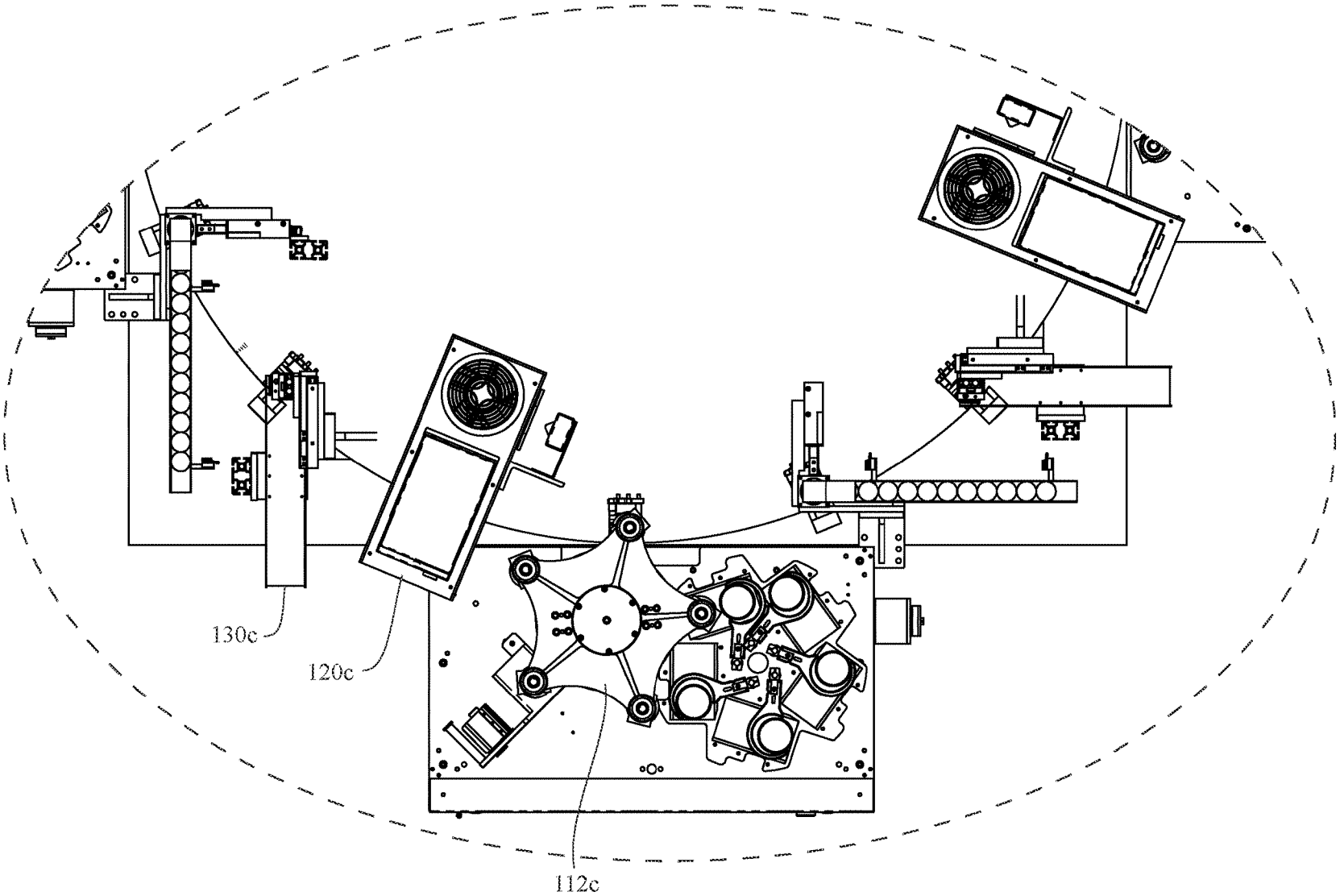
FIG. 1C is an isolated view of circle 1C of FIG. 1.
Figure 1D:
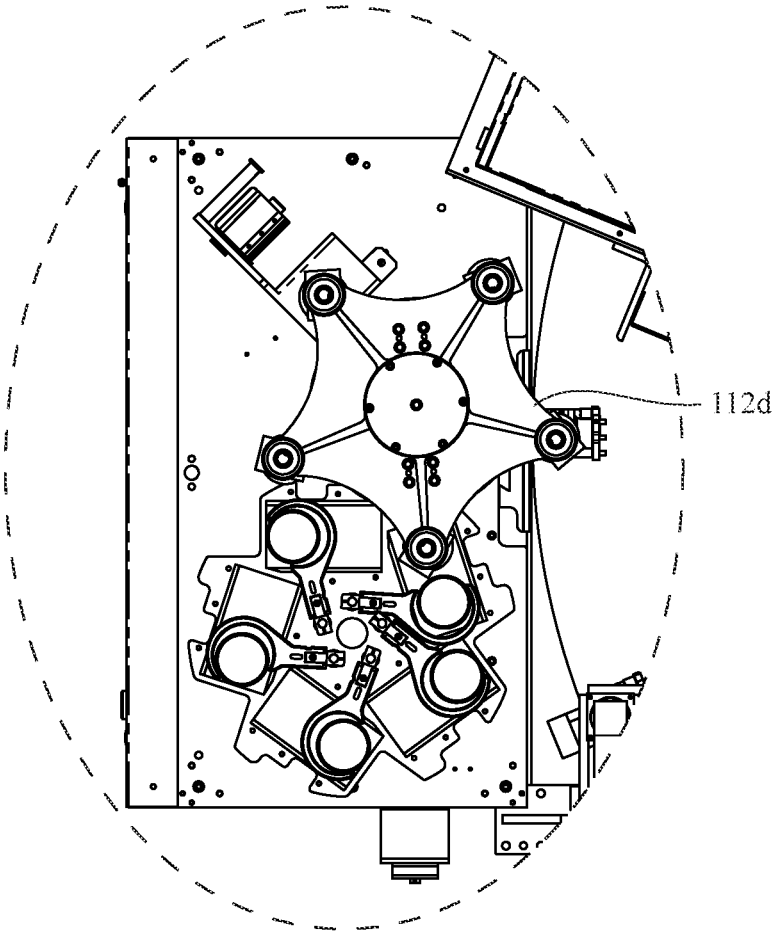
FIG. 1D is an isolated view of circle 1D of FIG. 1.
Figure 2:
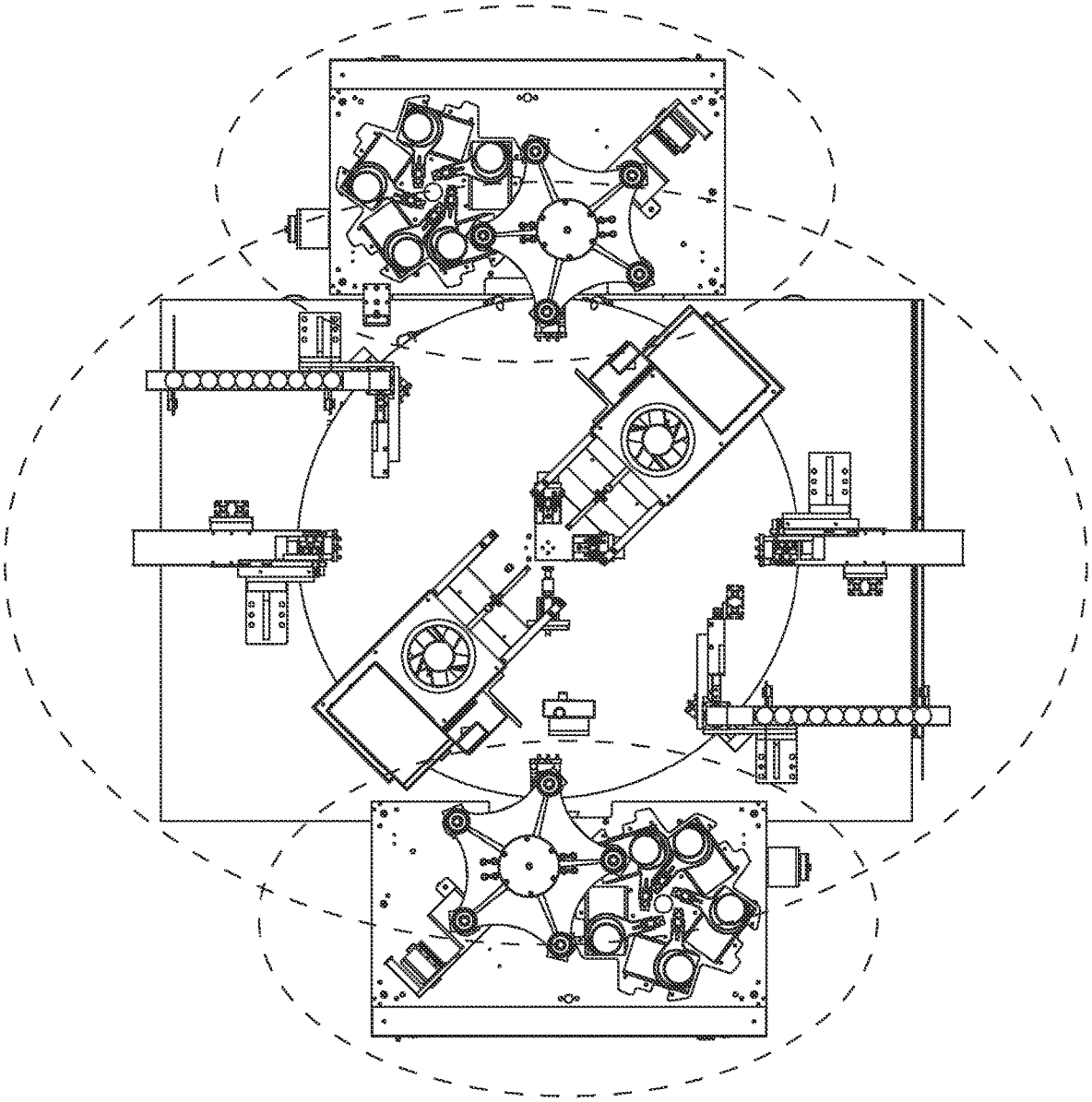
FIG. 2 is a top plan view of an alternative embodiment of a system for printing multiple colors on a golf ball.
Figure 2A:
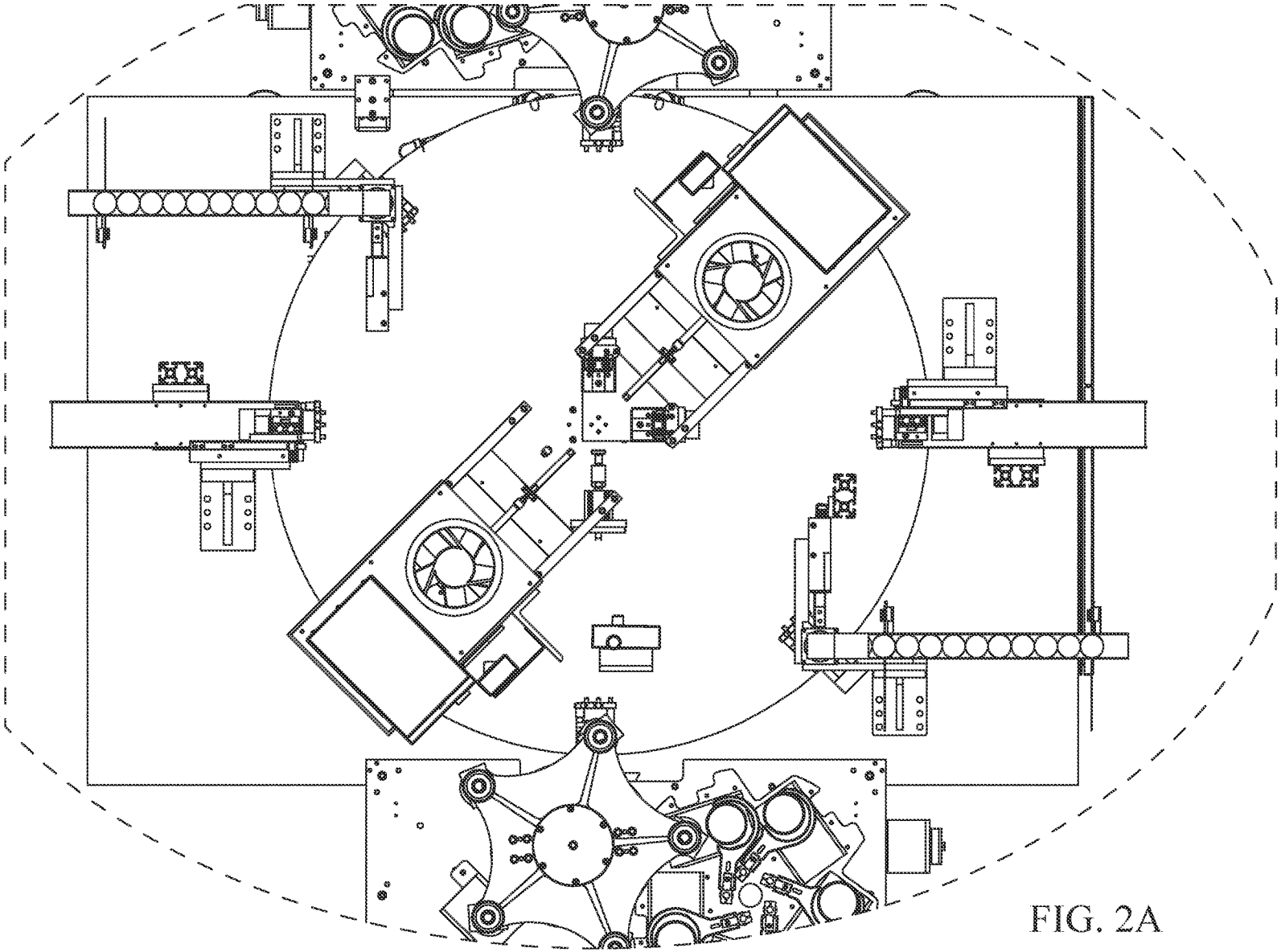
FIG. 2A is an isolated view of circle 2A of FIG. 2.
Figure 2B:
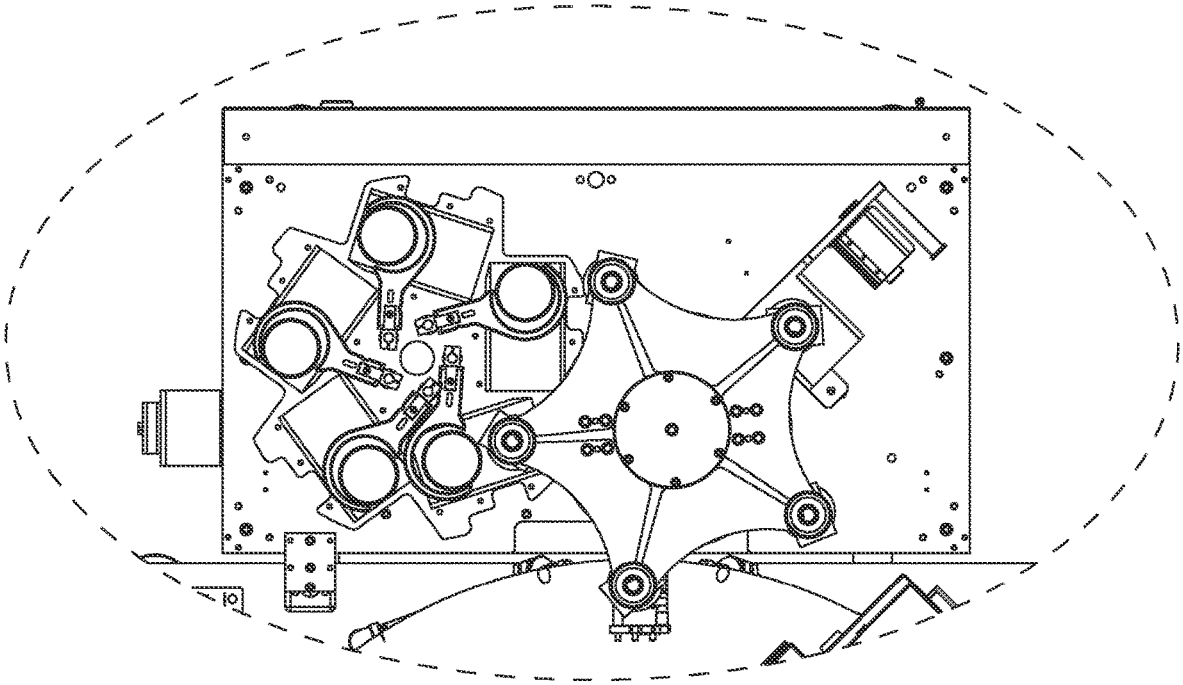
FIG. 2B is an isolated view of circle 2B of FIG. 2.
Figure 2C:
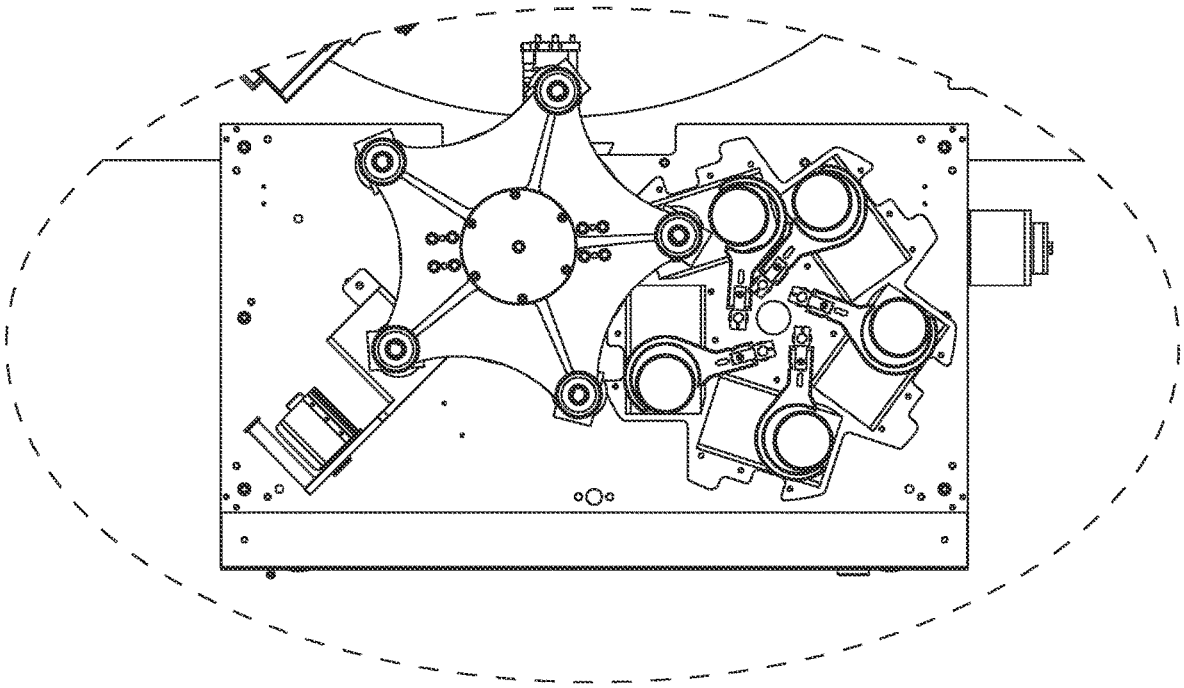
FIG. 2C is an isolated view of circle 2C of FIG. 2.
Figure 3:
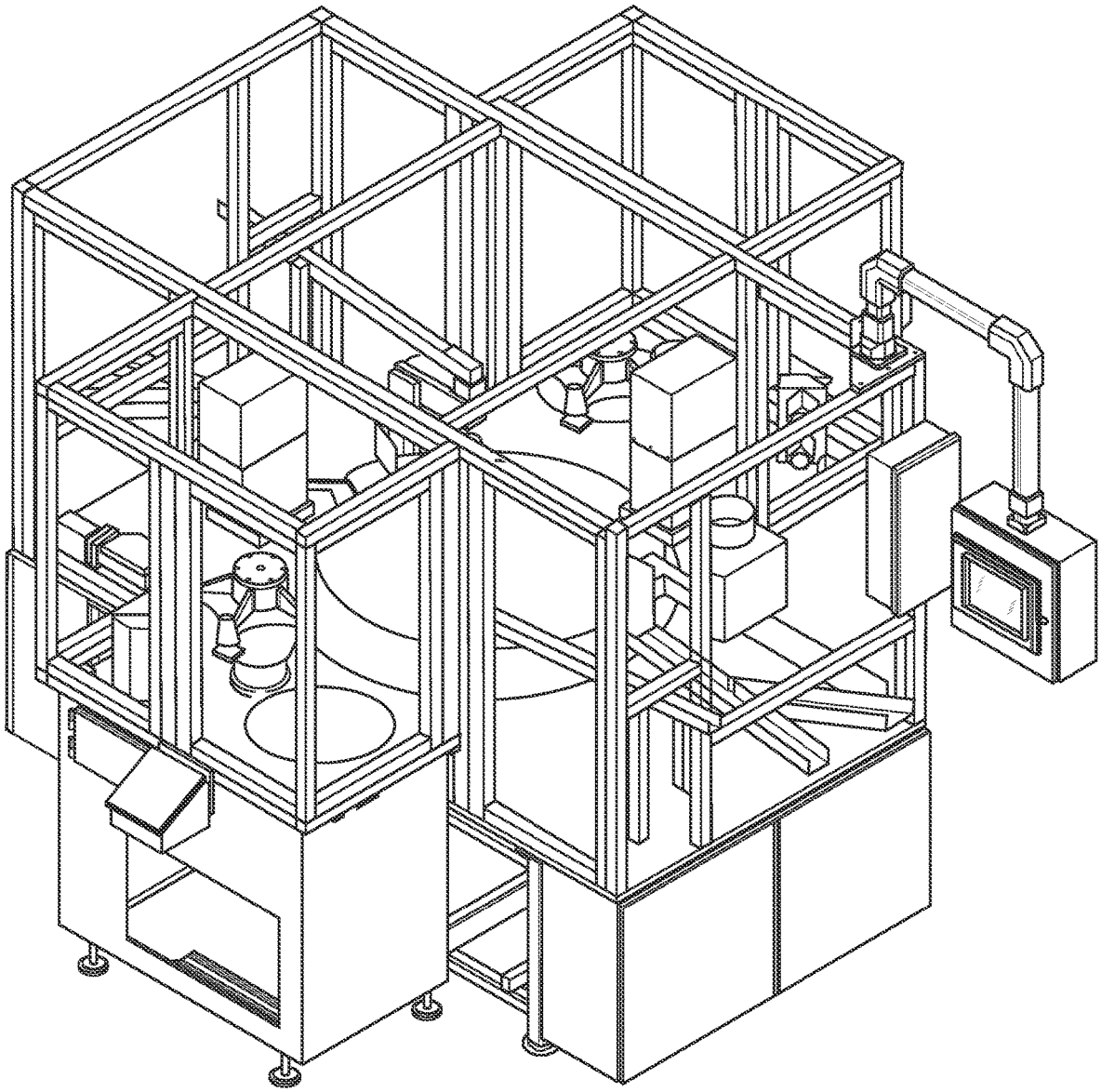
FIG. 3 is a top perspective view of an alternative embodiment of a system for printing multiple colors on a golf ball.
Figure 4:
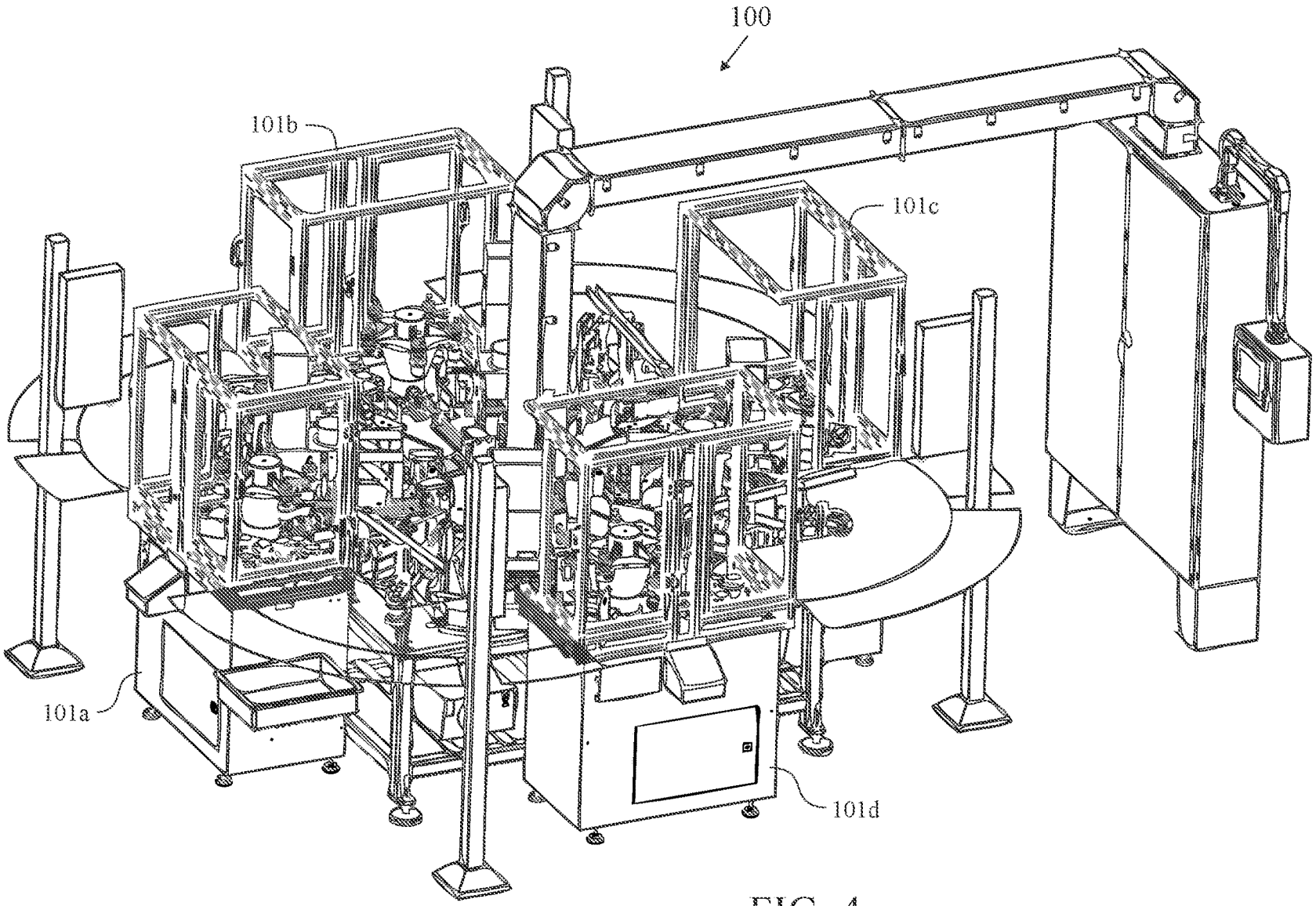
FIG. 4 is a top perspective view of a preferred embodiment of a system for printing multiple colors on a golf ball.

A system 100 for printing multiple colors on a golf ball is shown in FIGS. 1,1A, 1B, 1C, 1D and 4. The system 100 comprises a source of golf balls and a printing station. The printing station comprises a plurality of stamping stations 110*a*, 110*b*, 110*c* and 110*d*. Each of the plurality of stamping stations 110*a*, 110*b*, 110*c* and 110*d* comprising a pad carousel 112*a-d* comprising a plurality of pads 113*a* and 113*b*, a plurality of curing stations 120*a-d*, and a plurality of reorienting stations 130*a-d*. Golf balls from sources of golf balls 105*a*, 105*b*, 105*c* and 105*d* are loaded onto fixtures 111, 111*b*, 111*c* and 111*d* of the printing station for applying multiple colors onto each golf ball 25. FIG. 2 is a top plan view of an alternative embodiment of a system for printing multiple colors on a golf ball. FIG. 2A is an isolated view of circle 2A of FIG. 2. FIG. 2B is an isolated view of circle 2B of FIG. 2. FIG. 2C is an isolated view of circle 2C of FIG. 2. As shown in FIGS. 2, 2A, 2B and 2C, a system 200 for printing multiple colors on a golf ball comprises sources of golf balls 205*a* and 205*b* for loading golf balls onto a fixture 211*a* for printing by a pad carousels 212*a* or 212*b* (shown in FIG. 2B), which are cured at curing stations 220*a* and 220*b*, and reoriented at a reorienting station 230*a*. As shown in FIG. 3, the system 200 has two printing stations 201*a* and 201*b*. As shown in FIG. 4, the system 100 has printing stations 101*a*, 101*b*, 101*c* and 101*d*.

Figure 5A:
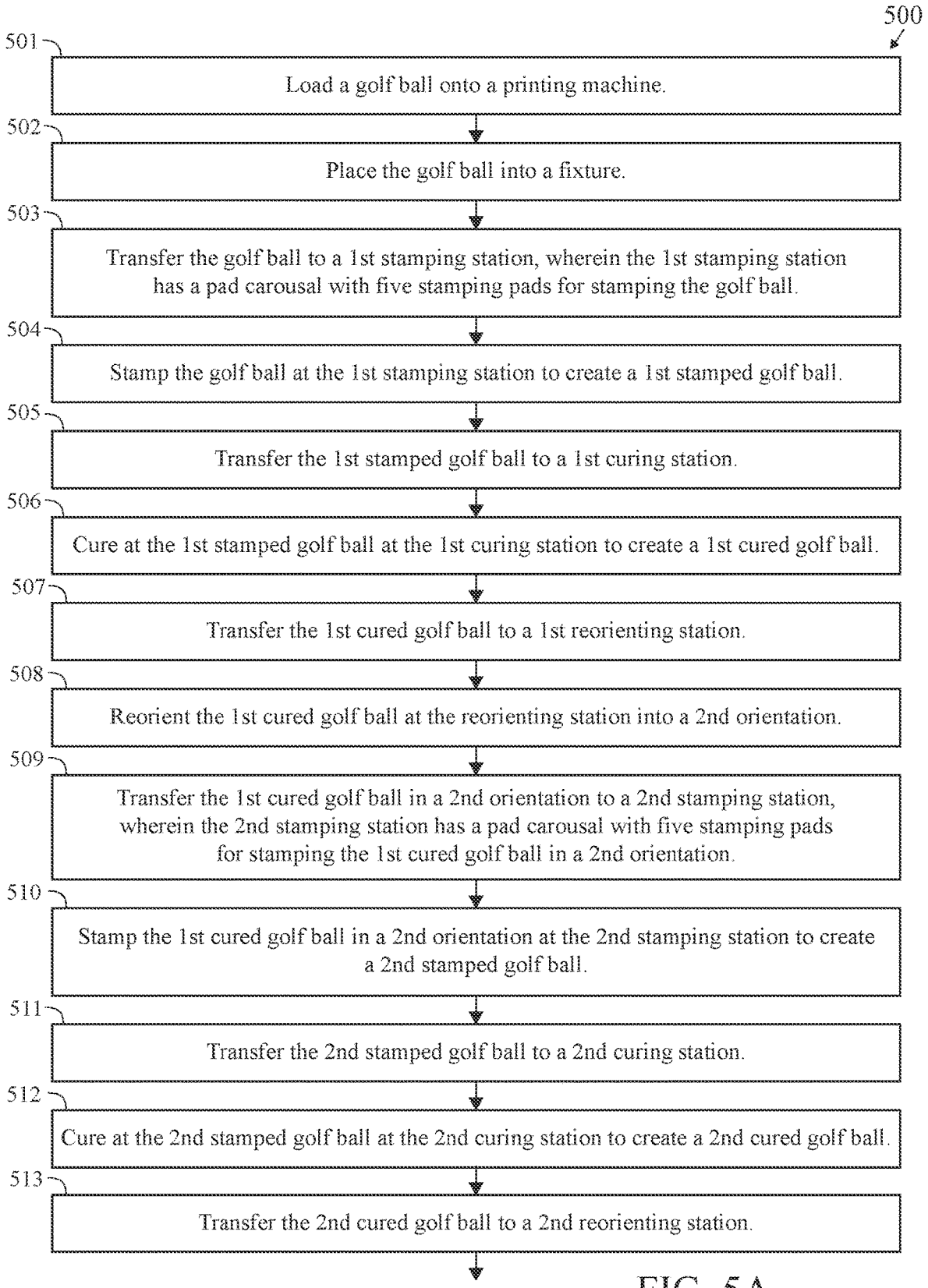
FIG. 5A is a flow chart of a preferred method for printing multiple colors on a golf ball.
Figure 5B:
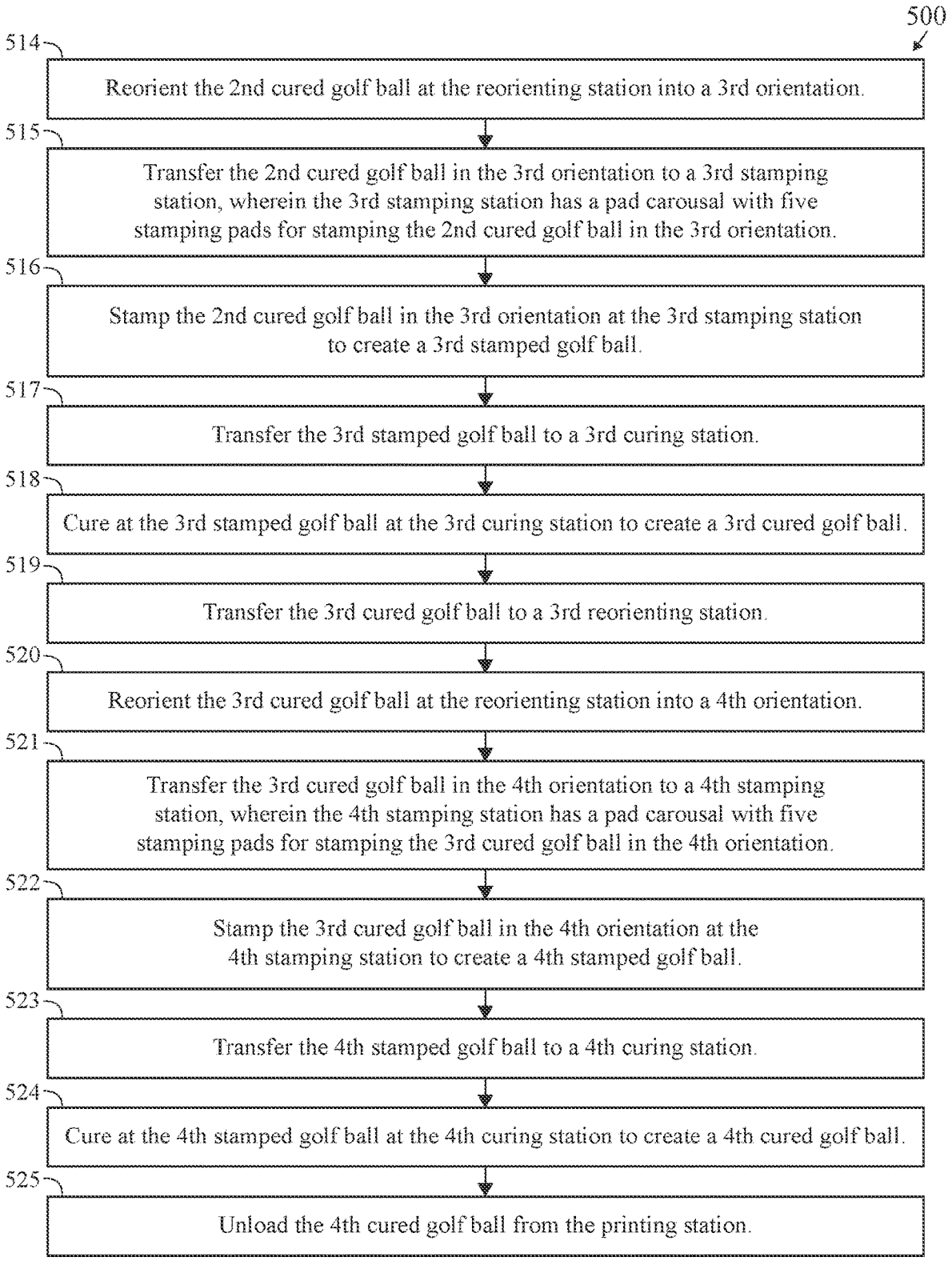
FIG. 5B is a continuation of the flow chart of FIG. 5A.

FIG. 5 is a flow chart of a preferred method 500 for printing multiple colors on a golf ball. The method includes the steps 501-525 as discussed below. The method includes loading a golf ball onto a printing machine. The method also includes placing the golf ball into a fixture. The method also includes transferring the golf ball to a first stamping station, wherein the first stamping station has a pad carousel with five stamping pads for stamping the golf ball. The method also includes stamping the golf ball at the first stamping station to create a first stamped golf ball. The method also includes transferring the first stamped golf ball to a first curing station. The method also includes curing at the first stamped golf ball at the first curing station to create a first cured golf ball. The method also includes transferring the first cured golf ball to a first reorienting station. The method also includes reorienting the first cured golf ball at the reorienting station into a second orientation. The method also includes transferring the first cured golf ball in a second orientation to a second stamping station, wherein the second stamping station has a pad carousel with five stamping pads for stamping the first cured golf ball in a second orientation. The method also includes stamping the first cured golf ball in a second orientation at the second stamping station to create a second stamped golf ball. The method also includes transferring the second stamped golf ball to a second curing station. The method also includes curing at the second stamped golf ball at the second curing station to create a second cured golf ball. The method also includes transferring the second cured golf ball to a second reorienting station. The method also includes reorienting the second cured golf ball at the reorienting station into a third orientation. The method also includes transferring the second cured golf ball in the third orientation to a third stamping station, wherein the third stamping station has a pad carousel with five stamping pads for stamping the second cured golf ball in the third orientation. The method also includes stamping the second cured golf ball in the third orientation at the third stamping station to create a third stamped golf ball. The method also includes transferring the third stamped golf ball to a third curing station. The method also includes curing at the third stamped golf ball at the third curing station to create a third cured golf ball. The method also includes transferring the third cured golf ball to a third reorienting station. The method also includes reorienting the third cured golf ball at the reorienting station into a fourth orientation. The method also includes transferring the third cured golf ball in the fourth orientation to a fourth stamping station, wherein the fourth stamping station has a pad carousel with five stamping pads for stamping the third cured golf ball in the fourth orientation. The method also includes stamping the third cured golf ball in the fourth orientation at the fourth stamping station to create a fourth stamped golf ball. The method also includes transferring the fourth stamped golf ball to a fourth curing station. The method also includes curing at the fourth stamped golf ball at the fourth curing station to create a fourth cured golf ball. The method also includes unloading the fourth cured golf ball from the printing station.

Figure 6:
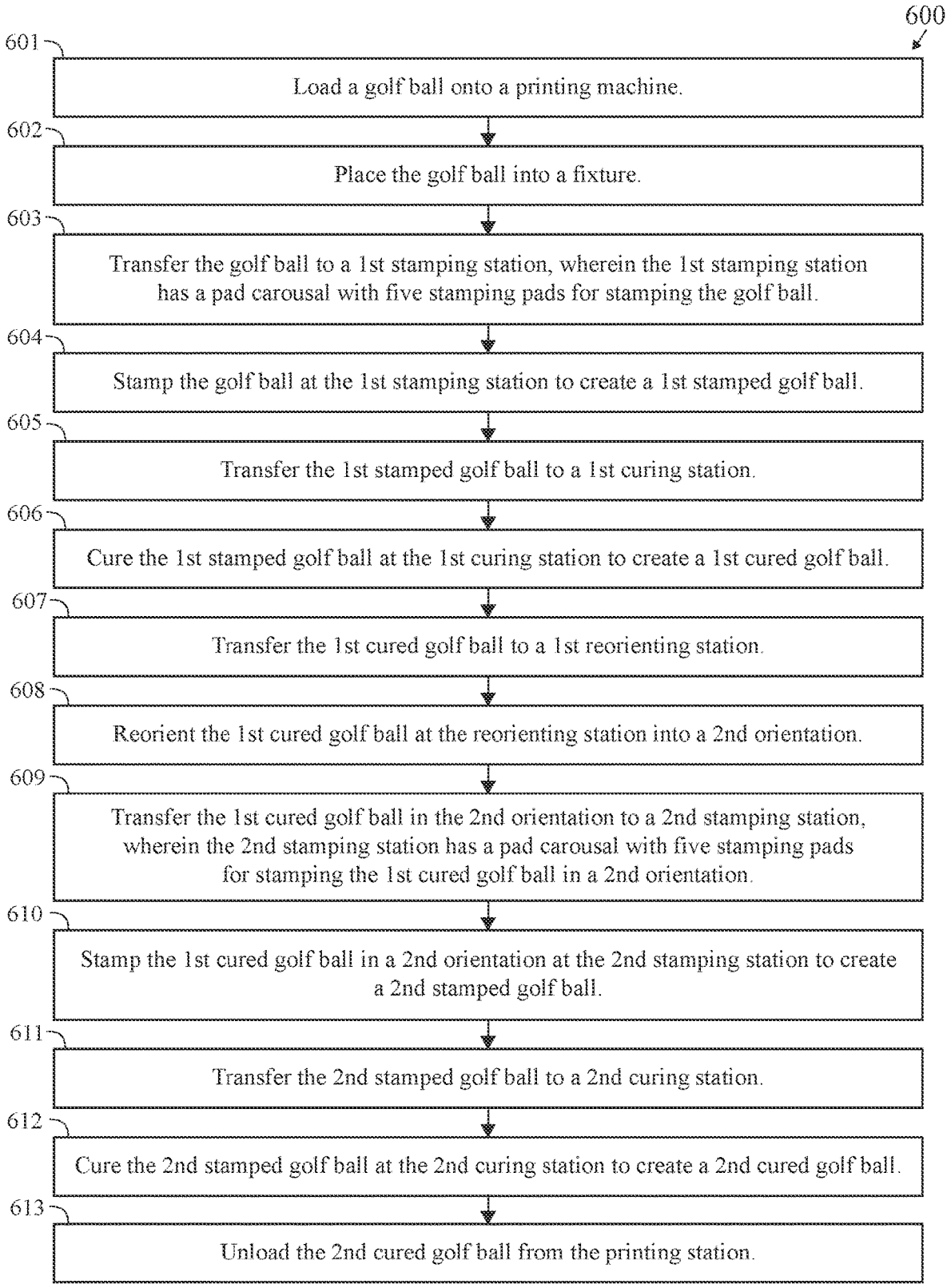
FIG. 6 is a flow chart of a preferred method for printing multiple colors on a golf ball.
Figure 9:
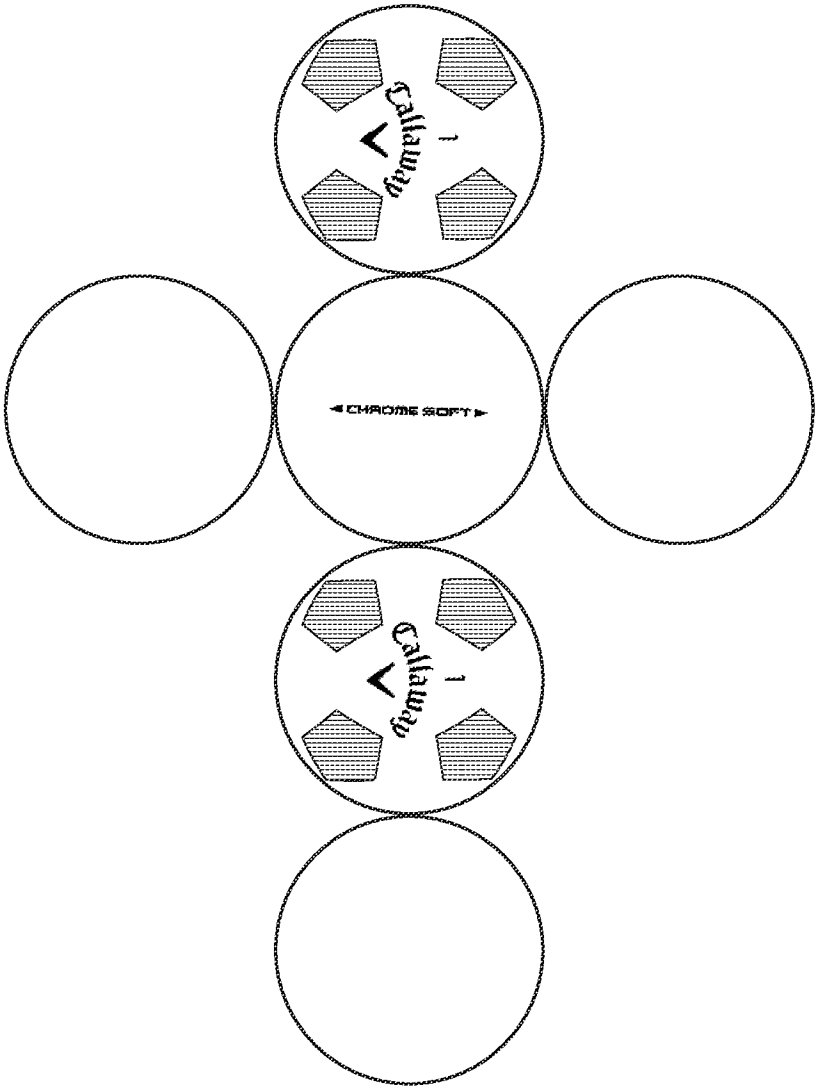
FIG. 9 is golf ball graphics.
Figure 10:
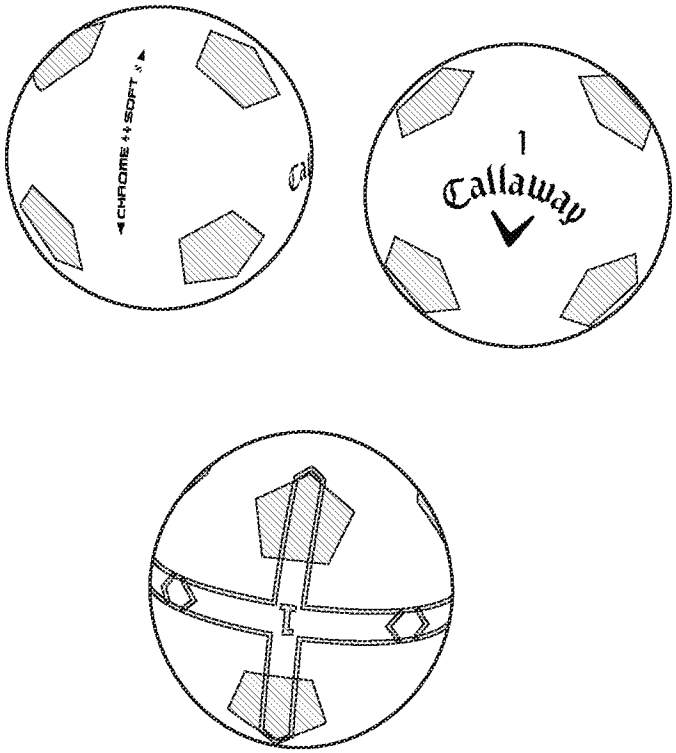
FIG. 10 is an image of golf balls.

FIG. 6 illustrates a method 600 for printing multiple colors on a golf ball in a single pass, which includes steps

601-613. The method includes loading a golf ball onto a printing machine. The method also includes placing the golf ball into a fixture. The method also includes transferring the golf ball to a first stamping station, wherein the first stamping station has a pad carousel with five stamping pads for stamping the golf ball. The method also includes stamping the golf ball at the first stamping station to create a first stamped golf ball. The method also includes transferring the first stamped golf ball to a first curing station. The method also includes curing at the first stamped golf ball at the first curing station to create a first cured golf ball. The method also includes transferring the first cured golf ball to a first reorienting station. The method also includes reorienting the first cured golf ball at the reorienting station into a second orientation. The method also includes transferring the first cured golf ball in the second orientation to a second stamping station, wherein the second stamping station has a pad carousel with five stamping pads for stamping the first cured golf ball in a second orientation. The method also includes stamping the first cured golf ball in the second orientation at the second stamping station to create a second stamped golf ball. The method also includes transferring the second stamped golf ball to a second curing station. The method also includes curing at the second stamped golf ball at the second curing station to create a second cured golf ball. The method also includes unloading the second cured golf ball from the printing station.

Another pattern utilized is set forth in Stahl et al., U.S. Pat. No. D410511 for a Golf Ball With A Pentagon Shaped Pattern which is hereby incorporated by reference in its entirety. Another pattern utilized is set forth in Stahl et al., U.S. Pat. No. D410979 for a Golf Ball With A Pentagon Shaped Pattern which is hereby incorporated by reference in its entirety. Another pattern utilized is set forth in Stahl et al., U.S. Pat. No. D412954 for a Golf Ball With A Spiral Pattern which is hereby incorporated by reference in its entirety. Another pattern utilized is set forth in Stahl et al., U.S. Pat. No. D415541 for a Golf Ball With A Ring Pattern which is hereby incorporated by reference in its entirety. Another pattern utilized is set forth in Stahl et al., U.S. Pat. No. D419626 for a Golf Ball With A Contour-Shaped Pattern which is hereby incorporated by reference in its entirety. Another pattern utilized is set forth in Stahl et al., U.S. Pat. No. D424143 for a Golf Ball With A Star-Shaped Pattern which is hereby incorporated by reference in its entirety. Another pattern utilized is set forth in Finley et al., U.S. Pat. No. D814578 for a Golf Ball, which is hereby incorporated by reference in its entirety. Another pattern utilized is set forth in Simonds et al., U.S. Pat. No. D815219 for a Golf Ball, which is hereby incorporated by reference in its entirety. Another pattern utilized is set forth in Finley et al., U.S. Patent Number D811498 for a Golf Ball, which is hereby incorporated by reference in its entirety. Another pattern utilized is set forth in Simonds et al., U.S. Patent Number D811499 for a Golf Ball, which is hereby incorporated by reference in its entirety. Another pattern utilized is set forth in Finley et al., U.S. Pat. No. D808477 for a Golf Ball, which is hereby incorporated by reference in its entirety One construction of a golf ball utilized with the present invention is disclosed in Ogg et al., U.S. Pat. No. 8,651,976 for a Multiple Layer Golf Ball, which is hereby incorporated by reference in its entirety. Another construction of a golf ball utilized with the present invention is disclosed in Ogg et al., U.S. Pat. No. 8,475,298 for a Golf Ball Having Dual Core Deflection Differential, which is hereby incorporated by reference in its entirety.

Components of current golf ball painting systems may be employed with the present invention, and an example of such components are disclosed Skrabski et al., U.S. Pat. No. 6,544,337 for a Golf Ball Painting System, which is hereby incorporated by reference in its entirety.

In a particularly preferred embodiment of the invention, the golf ball preferably has an aerodynamic pattern such as disclosed in Simonds et al., U.S. Pat. No. 7,419,443 for a Low Volume Cover For A Golf Ball, which is hereby incorporated by reference in its entirety. Alternatively, the golf ball has an aerodynamic pattern such as disclosed in Simonds et al., U.S. Pat. No. 7,338,392 for An Aerodynamic Surface Geometry For A Golf Ball, which is hereby incorporated by reference in its entirety. Alternatively, the golf ball has an aerodynamic pattern such as disclosed in Ogg, U.S. Pat. No. 6,551,203 for A Golf Ball With Multiple Sets Of Dimples, which is hereby incorporated by reference in its entirety.

In a preferred embodiment, the cover is preferably composed of a thermoplastic polyurethane material, and preferably has a thickness ranging from 0.025 inch to 0.04 inch, and more preferably ranging from 0.03 inch to 0.04 inch. The material of the cover preferably has a Shore D plaque hardness ranging from 30 to 60, and more preferably from 40 to 50. The Shore D hardness measured on the cover is preferably less than 56 Shore D. Preferably the cover 16 has a Shore A hardness of less than 96. Alternatively, the cover 16 is composed of a thermoplastic polyurethane/polyurea material. One example is disclosed in U.S. Pat. No. 7,367,903 for a Golf Ball, which is hereby incorporated by reference in its entirety. Another example is Melanson, U.S. Pat. No. 7,641,841, which is hereby incorporated by reference in its entirety. Another example is Melanson et al, U.S. Pat. No. 7,842,211, which is hereby incorporated by reference in its entirety. Another example is Matroni et al., U.S. Pat. No. 7,867,111, which is hereby incorporated by reference in its entirety. Another example is Dewanjee et al., U.S. Pat. No. 7,785,522, which is hereby incorporated by reference in its entirety.

Melanson et al. U.S. patent Ser. No. 10/022,954 for a Method For Printing An Image At Multiple Locations On Golf Ball, is hereby incorporated by reference in its entirety. Hanna et al. U.S. Pat. No. 9,283,443 for a Method For Printing An Image At Multiple Locations On Golf Ball, is hereby incorporated by reference in its entirety. Moylan, U.S. patent application Ser. No. 16/041,411, filed on Jul. 27, 2018, for a Method And System For Single Pass Printing A Multiple-Colored Image At Multiple Locations On Golf Ball, is hereby incorporated by reference in its entirety.

A discussion of the USGA initial velocity test is disclosed in Yagley et al., U.S. Pat. No. 6,595,872 for a Golf Ball With High Coefficient Of Restitution, which is hereby incorporated by reference in its entirety. Another example is Bartels et al., U.S. Pat. No. 6,648,775 for a Golf Ball With High Coefficient Of Restitution, which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims.

Therefore, the embodiments of the invention in which an exclusive property or privilege is claimed are defined in the following appended claims.

I claim as my invention the following:

1. A method for printing multiple colors on a golf ball, the method comprising:

loading a golf ball onto a printing machine;

stamping the golf ball with a first red line;

stamping the golf ball with two blue lines parallel to the first red line;

rotating the golf ball ninety degrees;

stamping the golf ball with a second red line;

stamping the golf ball with two blue lines parallel to the second red line;

rotating the golf ball one-hundred thirty-five degrees;

curing and rotating the golf ball;

rotating the cured golf ball;

stamping a first pole stamp on the cured golf ball;

rotating the cured golf ball one-hundred eighty degrees;

stamping a second pole stamp on the cured golf ball to create a pole-stamped golf ball;

curing the pole-stamped golf ball to create a cured pole-stamped golf ball; and unloading the cured pole-stamped golf ball from the printing machine.

2. The method according to claim 1 wherein the second red line overlaps a portion of the first red line to create a line that extends one-hundred eighty degrees around the golf ball.

3. The method according to claim 1 further comprising re-orientating the golf ball which comprises maintaining the golf ball in a fixture, exerting a vacuum on the golf ball using a vacuum cup, opening the fixture, moving the vacuum cup to reorient the golf ball through use of a servo motor, and closing the fixture around the reoriented golf ball.

4. The method according to claim 1 wherein the first red line and the second red line are thicker than the blue lines.

* * * * *